US010458686B2

(12) United States Patent
Jandal et al.

(10) Patent No.: US 10,458,686 B2
(45) Date of Patent: Oct. 29, 2019

(54) REFRIGERANT COOLING AND LUBRICATION SYSTEM WITH REFRIGERANT VAPOR VENT LINE

(71) Applicant: TRANE INTERNATIONAL INC., Davidson, NC (US)

(72) Inventors: Daoud Ali Jandal, La Crosse, WI (US); Brian Thomas Sullivan, La Crosse, WI (US); Steven Erwin Meloling, La Crosse, WI (US); Reginald Loyd Berry, Onalaska, WI (US); Ronald Allen Boldt, Stoddard, WI (US); Matthew Aron Witt, La Crosse, WI (US); Damion Scott Plymesser, De Soto, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 222 days.

(21) Appl. No.: 15/583,128

(22) Filed: May 1, 2017

(65) Prior Publication Data

US 2017/0234585 A1 Aug. 17, 2017

Related U.S. Application Data

(63) Continuation of application No. 14/763,442, filed as application No. PCT/US2014/013038 on Jan. 24, 2014, now Pat. No. 9,671,146.

(60) Provisional application No. 61/793,631, filed on Mar. 15, 2013, provisional application No. 61/793,197, filed on Mar. 15, 2013, provisional application No.

(Continued)

(51) Int. Cl.

| | |
|---|---|
| ***F25B 31/00*** | (2006.01) |
| ***F25B 45/00*** | (2006.01) |

(52) U.S. Cl.

CPC ..... *F25B 31/002* (2013.01); *F25B 45/00* (2013.01); *F25B 31/004* (2013.01); *F25B 2339/047* (2013.01); *F25B 2400/0403* (2013.01); *F25B 2400/13* (2013.01); *F25B 2500/01* (2013.01);

(Continued)

(58) Field of Classification Search

CPC ... F25B 31/002; F25B 31/004; F25B 2500/16

See application file for complete search history.

(56) References Cited

U.S. PATENT DOCUMENTS

| | | | |
|---|---|---|---|
| 3,643,460 | A | 2/1972 | Garland |
| 3,827,249 | A | 8/1974 | Garland et al. |

(Continued)

FOREIGN PATENT DOCUMENTS

| | | | |
|---|---|---|---|
| CN | 1047729 | A | 12/1990 |
| CN | 1278904 | A | 1/2001 |

(Continued)

OTHER PUBLICATIONS

International Search Report and Written Opinion for International Application No. PCT/US2014/013038, dated May 20, 2014, 10 pgs.

*Primary Examiner* — David J Teitelbaum

(74) *Attorney, Agent, or Firm* — Hamre, Schumann, Mueller & Larson, P.C.

(57) ABSTRACT

Generally, apparatuses, systems, and methods are described to vent refrigerant vapor from the refrigerant pump line using a vent line, such as during priming of the pump and/or during a startup of the compressor, directed to a relatively reduced volute casing mass of the refrigerant pump, and/or directed to returning refrigerant to an economizer or chiller component other than the condenser.

11 Claims, 6 Drawing Sheets

Related U.S. Application Data

61/793,486, filed on Mar. 15, 2013, provisional application No. 61/757,079, filed on Jan. 25, 2013, provisional application No. 61/757,083, filed on Jan. 25, 2013, provisional application No. 61/757,081, filed on Jan. 25, 2013.

(52) U.S. Cl.
CPC ..... *F25B 2500/16* (2013.01); *F25B 2500/26* (2013.01)

(56) References Cited

U.S. PATENT DOCUMENTS

| | | | |
|---|---|---|---|
| 3,864,934 | A | 2/1975 | Jeding et al. |
| 4,404,812 | A | 9/1983 | Zinsmeyer |
| 5,046,320 | A | 9/1991 | Loose et al. |
| 5,319,945 | A | 6/1994 | Bartlett |
| 5,675,978 | A | 10/1997 | Hamm, Jr. et al. |
| 5,724,821 | A | 3/1998 | Lord et al. |
| 5,848,538 | A | 12/1998 | Tischer |
| 5,967,744 | A | 10/1999 | Danner |
| 6,065,297 | A | 5/2000 | Tischer et al. |
| 6,116,046 | A | 9/2000 | Leaver et al. |
| 6,176,092 | B1 | 1/2001 | Butterworth et al. |
| 6,250,102 | B1 | 6/2001 | Tischer |
| 6,564,560 | B2 | 5/2003 | Butterworth et al. |
| 8,297,073 | B2 | 10/2012 | Kawano et al. |
| 8,434,323 | B2 | 5/2013 | Welch et al. |
| 2001/0037651 | A1 | 11/2001 | Butterworth et al. |
| 2005/0013690 | A1 | 1/2005 | Borrowman et al. |
| 2007/0114168 | A1 | 5/2007 | Hazlehurst |
| 2008/0060365 | A1 | 3/2008 | Sakitani et al. |
| 2008/0271477 | A1 | 11/2008 | Holmes |
| 2010/0006264 | A1 | 1/2010 | Jadric et al. |
| 2011/0123370 | A1 | 5/2011 | Kim et al. |

FOREIGN PATENT DOCUMENTS

| | | | |
|---|---|---|---|
| CN | 1322289 | A | 11/2001 |
| CN | 1322290 | A | 11/2001 |
| CN | 101180507 | A | 5/2008 |
| CN | 201162724 | Y | 12/2008 |
| CN | 101949619 | A | 1/2011 |
| GB | 1380758 | A | 1/1975 |
| JP | 2000227088 | A | 8/2000 |

REFRIGERANT COOLING AND LUBRICATION SYSTEM WITH REFRIGERANT VAPOR VENT LINE

FIELD

The disclosure herein relates to heating, ventilation, and air-conditioning ("HVAC") or refrigeration systems, such as may include a chiller, and more particularly relates to providing refrigerant to cool the system, such as for cooling moving parts that may be part of the compressor, for example the compressor motor and the compressor bearings, and/or for cooling drives such as an adjustable or variable frequency drive. Generally, methods, systems, and apparatuses are described that are directed to venting refrigerant vapor from the refrigerant pump line using a vent line, to a relatively reduced volute casing mass of the refrigerant pump, and/or to returning refrigerant to an economizer or chiller component other than the condenser.

BACKGROUND

A HVAC or refrigeration system, such as may include a chiller, can include a compressor, a condenser, an evaporator and an expansion device. In a cooling cycle of the HVAC or refrigeration system, the compressor can compress refrigerant vapor, and the compressed refrigerant vapor may be directed into the condenser to condense into liquid refrigerant. The liquid refrigerant can then be expanded by the expansion device and directed into the evaporator. Chiller systems typically incorporate standard components of a refrigeration circuit to provide chilled water for cooling, such as for example building spaces. A typical refrigeration circuit includes a compressor to compress refrigerant gas, a condenser to condense the compressed refrigerant to a liquid, and an evaporator that utilizes the liquid refrigerant to cool water. The chilled water can then be piped to locations for desired end use(s).

Components of the HVAC or refrigeration system, such as the compressor, may include moving parts, and therefore may require lubrication during operation. Lubricants, such as oil, are commonly used in the HVAC or refrigeration system to lubricate the moving parts.

SUMMARY

In some HVAC or refrigeration systems, liquid refrigerant can be used as a lubricant for components with moving parts, such as the moving parts of a compressor, including its motor and bearings therein. At shut off of a chiller, for example, refrigerant tends to migrate to the evaporator such as after and during a period of chiller shut off, so liquid refrigerant can be located in the evaporator. At start up, there can be an issue of whether the refrigerant pump is primed with a suitable and appropriate pressure differential so as to confirm a refrigerant flow through the refrigerant pump. This can be important, for example before starting the compressor of an oil free chiller. If there is not an appropriate pressure differential, the moving parts of the chiller, such as for example the bearings in the compressor, its motor, and the drive could not operate appropriately, can be at risk for damage, and the chiller overall may not function at desired efficiency due to the inadequate or ineffective refrigerant cooling and lubrication of the compressor.

To start the chiller, there may be a need to prime the pump. By shutting off the condenser water pump, the refrigerant pump can be primed, and sourcing can be started for example from the evaporator to establish refrigerant flow and an appropriate pressure differential. A signal can be obtained that there is an appropriate pressure differential so to allow refrigerant to be delivered to the refrigerant pump and to allow the compressor to be started and also the condenser water pump. While this solution may be a possibility, it is not always practical to turn off the condenser water pump, if for example an HVAC or refrigeration system has multiple chillers, and there are certain areas of the system that could be impacted based on the system design.

Improvements can be made to provide liquid refrigerant to the moving parts during startup. Generally, apparatuses, systems, and methods are described that are directed to venting refrigerant vapor from the refrigerant pump line using a vent line, such as during priming of the pump and/or during a start up of the compressor, directed to a relatively reduced volute casing mass of the refrigerant pump, and/or directed to returning refrigerant to an economizer or chiller component other than the condenser.

For example during a startup or restart of the compressor, liquid refrigerant may be sourced from the evaporator by opening a source valve on the evaporator source line. Once confirmation is given that there exists an appropriate pressure differential, e.g. $\Delta p$, this confirmation can be done by using a unit controller that receives a signal from one or more appropriately positioned pressure transducers, such as along the refrigerant pump line. Once $\Delta p$ is established, which in some examples can be about 2 psi, there can be confirmation that there would be sufficient refrigerant flow to the compressor, so liquid refrigerant can flow to parts that may be in need of lubrication. Then the unit controller can start the compressor. After starting the compressor, there can be liquid refrigerant from operation of the condenser, so that the unit controller can close the source valve on the evaporator source line and open a source valve on the condenser source line, so that liquid refrigerant sourcing can be from the condenser.

Hereafter the term "source valve" is generally meant as a flow control device that allows or does not allow refrigerant into the refrigerant pump and refrigerant pump line. In some embodiments, any one or more of the source valves can be solenoid valves controlled by a unit controller.

In one embodiment, a refrigerant cooling and lubrication assembly which may be used in an HVAC or refrigeration system and/or HVAC or refrigeration unit, such as a water chiller can include a condenser source line, an evaporator source line, a refrigerant pump line, a refrigerant pump, and a vent line. The condenser source line and the evaporator source line are fluidly connected and can feed into the refrigerant pump line. The refrigerant pump is located on the refrigerant pump line, which can be connected to a compressor motor. On the condenser source line, a source valve is disposed that can have an open state and a closed state. On the evaporator source line, a source valve is disposed that can have an open state and a closed state. The source valve on the condenser source line is configured to decouple the condenser from the refrigerant cooling and lubrication assembly in the closed state, such as during a compressor startup condition, and is configured to allow refrigerant flow from the condenser to flow through condenser source line in the open state. The source valve disposed on the condenser source line allows for the condenser to be decoupled, such as for example the effects of its water pump if in operation, so that there is no adverse effect on the lubrication and cooling of the compressor, such as at startup. The vent line is fluidly connected to the refrigerant pump line to relieve the refrigerant pump line of vapor refrigerant flowing through the refrigerant pump line and upstream from delivery to the compressor.

By the term "decouple", "decouples", or "decoupled", it is to be appreciated that such terms are meant and intended as generally stopping fluid flow from one component to another component. For example, to decouple the condenser from a pump source line or feed can be accomplished by activating a flow control device, such as along the condenser source line, to an off state to stop fluid flow, e.g. refrigerant vapor, from entering the feed or source line to the pump and flowing to the pump. Such effect can help to avoid or at least reduce an educator/jet-like or accelerated fluid flow, which may be susceptible to entraining vapor into a relatively lower or middle pressure flow (e.g. bringing vapor into suction), which may not be desirable for pump operation, e.g. may result in pump cavitation(s).

In some embodiments, the overall mass of a volute casing of the refrigerant pump can be reduced externally and internally to reduce its thermal mass which can help with reducing the amount of refrigerant vapor that may be present in the refrigerant pump line.

In some embodiments, refrigerant return can be to the economizer of a chiller rather than the condenser, and which can be used to cool a drive of the chiller.

Other features and aspects of the fluid management approaches will become apparent by consideration of the following detailed description and accompanying drawings.

BRIEF DESCRIPTION OF THE DRAWINGS

Reference is now made to the drawings in which like reference numbers represent corresponding parts throughout.

DETAILED DESCRIPTION

A HVAC or refrigeration system, such as a chiller system, may commonly include components with moving parts, such as a compressor. The moving parts generally require proper lubrication. The lubrication is commonly provided by lubricants, such as oil. In some HVAC or refrigeration systems, the lubrication can be provided by liquid refrigerant. Such a HVAC or refrigeration system is sometimes called an oil-free system. In the oil-free system, liquid refrigerant can be directed to surfaces of the moving parts for lubrication. Improvements can be made to direct liquid refrigerant to the moving parts when, for example, the HVAC or refrigeration system such as may include a chiller that starts from an off cycle. Such startup conditions of the compressor may be due, for example but are not limited to, a shut off occurring during periodic schedules such as in comfort cooling applications, and/or servicing or testing of one or more of the chillers in a larger system scheme, and/or a power surge or outage.

The embodiments as disclosed herein describe methods and systems directed to vent refrigerant vapor from the refrigerant pump line using a vent line, such as during priming of the pump and/or during a startup of the compressor, directed to a relatively reduced volute casing mass of the refrigerant pump, and/or directed to returning refrigerant to an economizer or chiller component other than the condenser.

Figure 1:
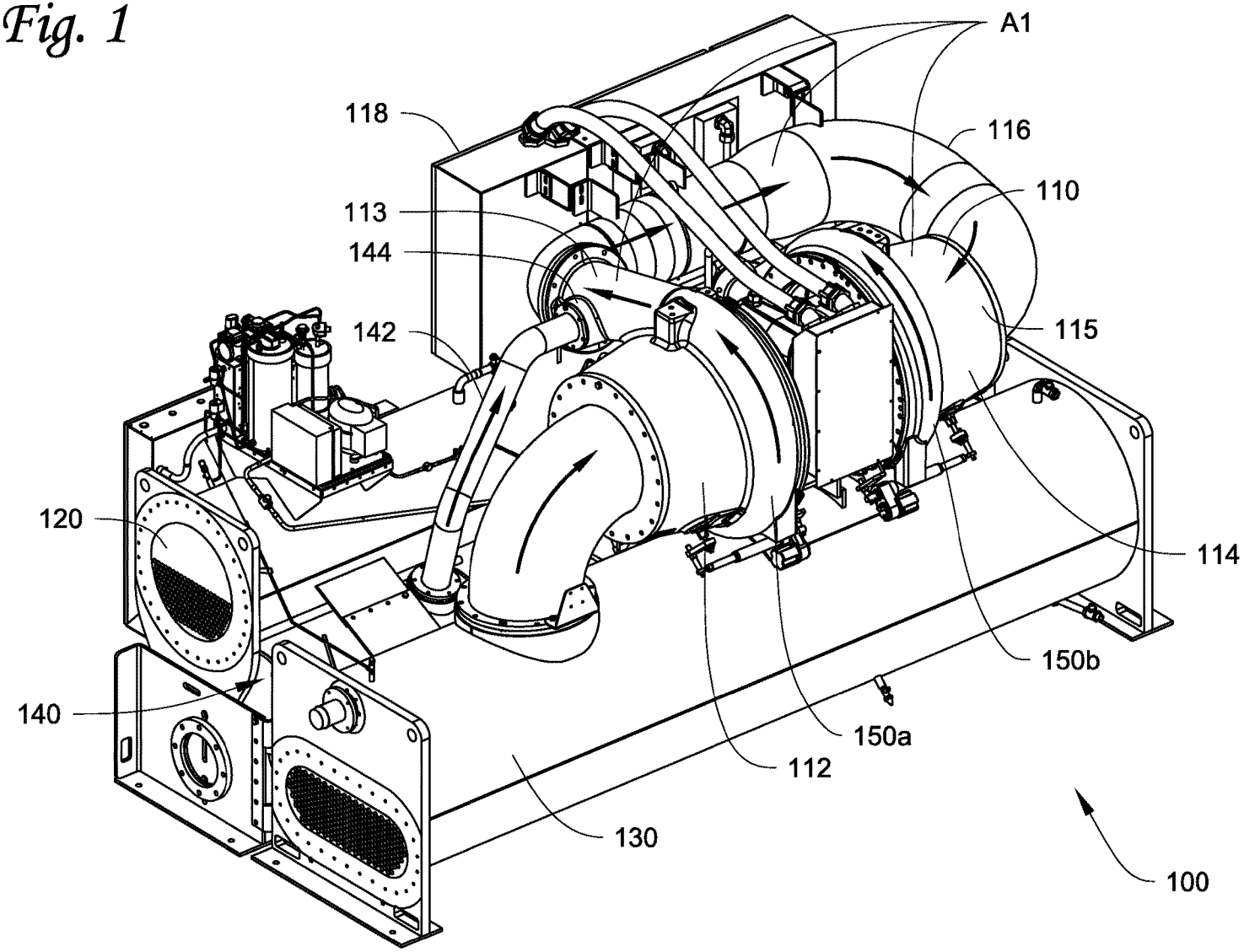
FIG. 1 illustrates a perspective view of one example of chiller, in particular a centrifugal water chiller, according to one embodiment.

FIG. 1 illustrates a perspective view of one example of chiller 100, such as for an HVAC or refrigeration system according to one embodiment. In particular, FIG. 1 shows a water chiller with a centrifugal compressor, e.g. a centrifugal chiller.

In the embodiment shown, the chiller 100 includes a compressor 110 that is configured to have a first compression stage 112 and a second compression stage 114. The compressor 110 can be a centrifugal compressor. It will be appreciated that the type of chiller is merely exemplary and not meant to be limiting, as other chiller types that may use other types of compressors may suitably employ and implement the refrigerant pump priming and refrigerant sourcing approaches shown and described herein. It will also be appreciated that the number of stages of compression is merely exemplary, and that more or less than two stages of compression may suitably be implemented with the refrigerant pump priming and refrigerant sourcing approaches shown and described herein, as long as for example such compression components and moving parts that may be in need of refrigerant lubrication and cooling are configured to receive refrigerant provided from the refrigerant pump.

In some examples, the chiller 100 can be one of many chillers in an overall system that has a heat rejection unit, such as a cooling tower, where one or more condenser water pumps may be used to run water through the condensers of the chillers to reject heat to the environment from the chillers.

With further reference to the general structure of the chiller 100 shown in FIG. 1, the first compression stage 112 and the second compression stage 114 include a first volute 150*a* and a second volute 150*b* respectively. The chiller 100 also includes a condenser 120, an evaporator 130 and an economizer 140. A run-around pipe 116 is configured to fluidly connect the first compression stage 112 to the second compression stage 114 to form fluid communication between the first compression stage 112 and the second compression stage 114. The run-around pipe 116 is fluidly connected to a discharge exit 113 of the first compression stage 112 and an inlet 115 of the second compression stage 114. The discharge exit 113 is in fluid communication with the first volute 150*a*. The run-around pipe 116, the discharge exit 113 and the inlet 113 form a refrigerant conduit A1, which is configured to direct a refrigerant flow. The economizer 140 is configured to have an injection pipe 142 forming fluid communication with the refrigerant conduit A1 through an injection port 144. The injection pipe 142 is configured to direct vaporized flash refrigerant from the economizer 140 to the injection port 144.

Refrigerant flow directions when the chiller 100 is in operation are generally illustrated by the arrows. The refrigerant flow directions are typically in accordance with refrigerant passages, such as defined by the refrigerant conduit A1 and the first and second volutes 150*a*, 150*b*. In operation, refrigerant vapor from the evaporator 130 can be directed into the first compression stage 112. A first impeller (not shown in FIG. 1) located in the first compression stage 112 can compress the refrigerant vapor from the evaporator 130. The compressed refrigerant vapor can be collected by the volute 150*a* and directed into the refrigerant conduit A1. The compressed refrigerant is directed into the inlet 115 of the second compression stage 114 along the refrigerant conduit A1. In the second compression stage 116, a second impeller (not shown in FIG. 1) can be configured to further compress the refrigerant and then direct the compressed refrigerant into the condenser 120 through the second volute 150*b*. In the condenser 120, the compressed refrigerant may be condensed into liquid refrigerant. The liquid refrigerant leaving the condenser 120 is then directed into the evaporator 130.

The chiller 100 can also have a section 118 having a unit controller that controls certain valves and/or receives input(s) from sensors, transducers on the chiller 100, such as any one or more of the valves and/or sensors on the refrigerant cooling and lubrication assembly 200 described below. The section 118 can also contain or be connected to the unit drive of the chiller 100.

In one embodiment, the controller can be operatively connected to a refrigerant cooling and lubrication assembly to provide liquid refrigerant to a pump, which thereafter can deliver liquid refrigerant to moving parts of the chiller, such as for example the compressor.

Figure 2:
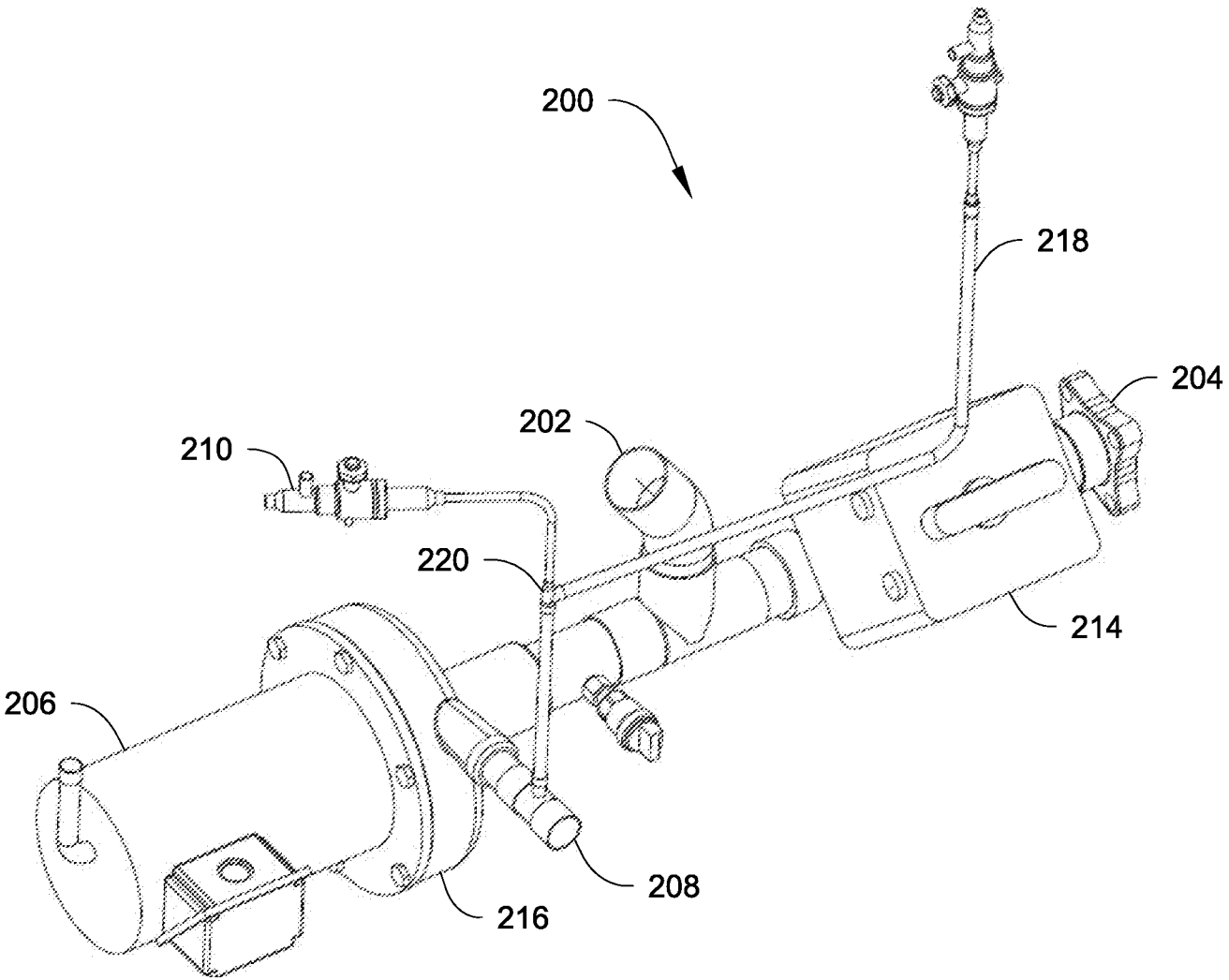
FIG. 2 shows one embodiment of a refrigerant cooling and lubrication assembly which may be implemented as part of a chiller system or unit.

FIG. 2 shows one embodiment of a refrigerant cooling and lubrication assembly 200 which may be implemented as part of a chiller system or unit, such as the chiller 100 shown in FIG. 1. The refrigerant cooling and lubrication assembly 200 may be appropriately piped into the condenser and evaporator, e.g. 120 and 130 in FIG. 1, so as to source refrigerant therefrom to the compressor, e.g. 110.

In one embodiment, a refrigerant cooling and lubrication assembly 200 which may be used in an HVAC or refrigeration system and/or HVAC or refrigeration unit, such as the water chiller 100, can include a condenser source line 202, an evaporator source line 204, a refrigerant pump line 208, a refrigerant pump 206, and a vent line 218. The condenser source line 202 and the evaporator source line 204 are fluidly connected and can feed into the refrigerant pump line 208. The refrigerant pump 206 is located on the refrigerant pump line 208, which can be connected to a compressor motor, e.g. the compressor 110 of FIG. 1. On the condenser source line 202, a source valve (not shown) may be disposed that can have an open state and a closed state. On the evaporator source line 204, a source valve 214 is disposed that can have an open state and a closed state. The source valve on the condenser source line 202 is configured to decouple the condenser, e.g. condenser 120 from the refrigerant cooling and lubrication assembly 200 in the closed state, such as during a compressor startup condition, and is configured to allow refrigerant flow from the condenser to flow through condenser source line 202 in the open state. The source valve disposed on the condenser source line 202 allows for the condenser to be decoupled, such as for example the effects of its water pump if in operation, so that there is no adverse effect on the lubrication and cooling of the compressor, such as at startup. A valve and line 210 can be fluidly connected to the refrigerant pump line 208 so as to allow refrigerant delivery to the drive of a chiller, e.g. chiller 100.

In operation, for example, the assembly 200 can prime the pump even in conditions where the condenser water pump may be running, e.g. such as when the condenser or another condenser in the system may still be active. For example, in one embodiment, the source valve on the condenser source line 202 to the refrigerant pump 206 is shut off, which isolates or decouples the condenser from the refrigerant cooling and lubrication function of the compressor and drive. The shut off of the source valve on the condenser source line can be by a signal from the unit controller to the source valve on the condenser source line. The refrigerant pump 206 can be primed, for example by turning on the refrigerant pump 206 and activating the source valve 214 on the evaporator source line 204 to an open position, which can allow sourcing of liquid refrigerant to the refrigerant pump 206. The activation of the source valve 214 on the evaporator source line 204 can be by a signal from the unit controller to turn the source valve 214 on. Once an appropriate $\Delta p$ is established, such as at about 2 psi, the unit may be started, then the source valve 214 on the evaporator source line 204 can be shut off, such as by the unit controller receiving a signal from a transducer(s), which the controller can signal the source valve 214 to turn off. The source valve on the condenser source line 202 may receive a signal to turn on so that sourcing can then be from the condenser.

With reference to the vent line 218, the vent line 218 as shown is fluidly connected to the refrigerant pump line 208 to relieve the refrigerant pump line 208 of vapor refrigerant flowing through the refrigerant pump line 208 and upstream from delivery to the compressor. The vent line can be useful for example in situations where there may be a risk of a high amount of vapor entering the refrigerant cooling and lubrication assembly. Such a situation may arise, for example, during restart of the chiller when there may be an interruption where the chiller shuts down for a relatively short time, such as e.g. a short power outage or loss or a backup power generator replacement, which may last seconds or only a few minutes. During the relative short duration of shut down, there can be vapor in the system, such as in the evaporator and/or condenser. In a restart, the vapor from the evaporator and/or condenser can be sucked into the refrigerant pump and delivered to the compressor, its motor, and the drive. The relative short time of shut down can be important in certain applications where constant cooling is needed, such as in a hospital setting, for example.

The vent line 218 can be oriented to access toward a top of the refrigerant pump line 208 as vapor may tend to travel along the top portion of the passage through the refrigerant pump line 208. Vapor can escape the refrigerant pump line 208 into the vent line as a low restriction pathway. The vent line 218 can have a flow control device such as solenoid valve (not shown) along the line 218, and which can be activated to a closed state, for example when there is no longer a need to vent, such as when flow through the refrigerant pump line is liquid refrigerant or substantially liquid refrigerant that would be suitable to cool and lubricate the compressor, motor, drive. Such a flow control device may be disposed at position 220, but may be at other locations along the fluid connection of the refrigerant pump line 208 and the vent line 218.

Generally, the vent line 218 is a flow passage from a portion of relatively low resistance pathway from the refrigerant pump line 208 for refrigerant vapor to escape the refrigerant pump line 208, which in some cases can be toward a top of the refrigerant pump line. It will be appreciated that the specific arrangement of the vent line 218 as shown is not meant to be limiting as other arrangements, placements, and locations of the vent line may also be suitable. It will be appreciated that more than one vent line could be suitably employed if desired and/or needed.

With further reference to FIG. 2, the pump 206 includes a volute casing 216, which can be a casted part of the refrigerant pump 206. In another embodiment, a casing of the volute of the refrigerant pump can be configured to help with vapor relief. Generally, a lower mass of the volute casing can help reduce the thermal mass of the casting, which can reduce the vapor effect on the priming of the pump. For example during a restart relatively hot or warm refrigerant from the condenser can tend to mix with the relatively cool refrigerant from the evaporator which tends to expand and evaporate in the refrigerant pump line to create more vapor and result in some reduction of liquid refrigerant in the refrigerant pump line.

In some embodiments, the volute casting can be relatively light weight at about 12 pounds or somewhat less, and which can be significantly over 50% reduction of casing mass to some previous designs, which have been about or above 26 pounds. By reducing the volute casing, such as from outside the casing, the temperature inside the pump can be kept lower to help with the potential issue of hot and cold refrigerant mixing. The reduction of the volute casting to reduce such thermal mass issue can be useful in pumps, such as refrigerant pumps that are limited in size and limited in the available pressure or suction head due to, for example, chiller footprint requirements and constraints. It will be appreciated that the reduced mass volute casings described herein are suitable at operating design pressures of up to about 50 psig, and are suitable to withstand hydrostatic pressures of the pump of about 250 psig. It will also be appreciated that the reduced mass volute casings described herein have been tested to contribute to reductions in time to restart the system, e.g. chiller, at about 30 seconds relative to about 2 minutes when compared to previous designs or designs with volute casings having more thermal mass.

Figure 3A:
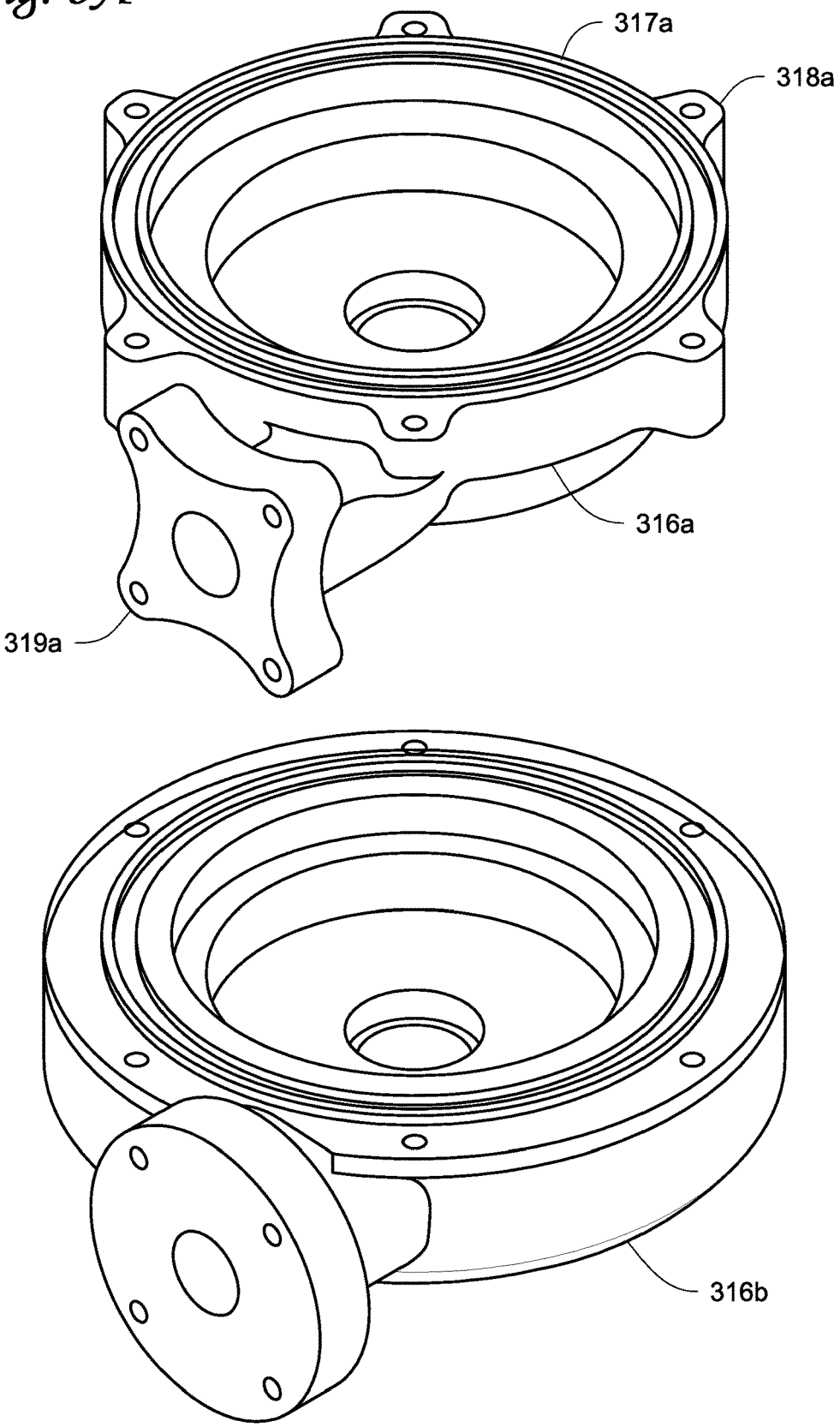
FIGS. 3A to 3C illustrate a volute casing of a refrigerant pump with reduced mass on the external relative to a volute casing currently in production.
Figure 3B:
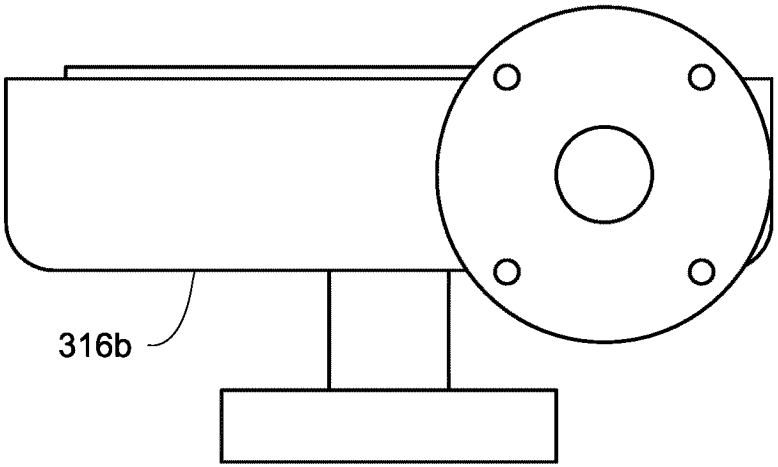
Figure 3B:
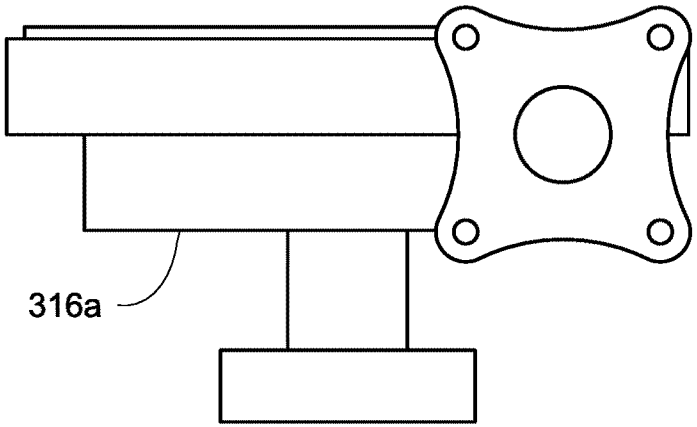
Figure 3C:
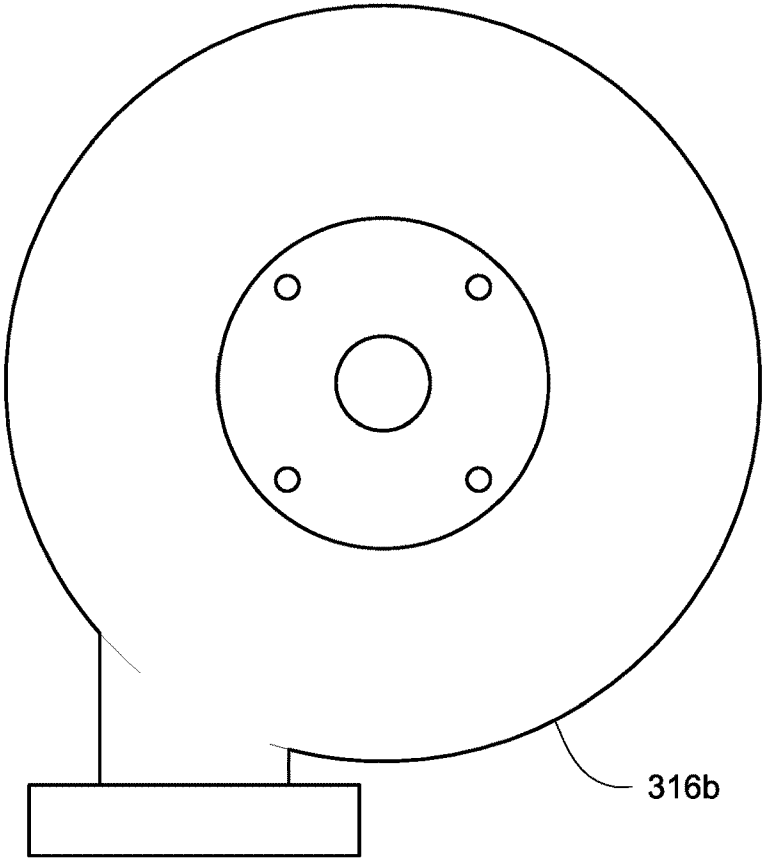
Figure 3C:
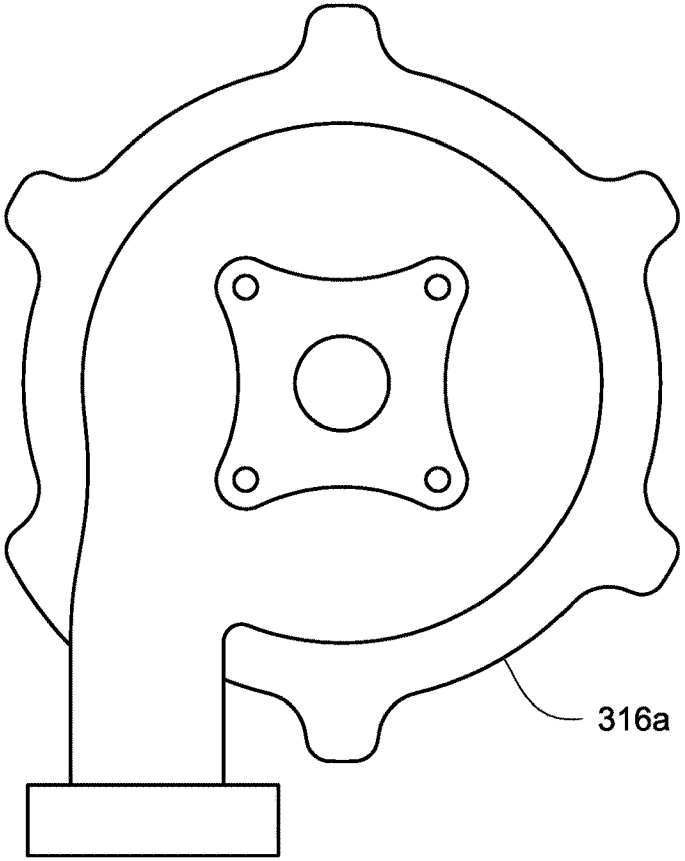

FIGS. 3A to 3C illustrate a volute casing 316*a* of a refrigerant pump with reduced mass on the external relative to a volute casing 316*b* currently in production. As shown in FIGS. 3A to 3C, external and internal portions of the volute casing 316*a* have been removed to reduce the overall mass of the volute casing. For example, as shown in FIG. 3A, tabs 318*a* are positioned about the outer circumference of the volute casing 316*a* whereas the outer circumference of the volute casing 316*b* is generally uniform and circular. The tabs 318*a* provide the structural assembly locations, such as for example bolt holes, for the volute casing 316*a* to connect to the pump housing. Areas just inside the sealing ring 317*a* just inside of the tabs 318*a* have been reduced in material and mass and tapered (e.g. in the direction looking down into the drawing page). Connecting flange 319*a* has reduced mass with a star-like shape or four leaf clover with four tabs or leaves that have the assembly points, such as for bolt holes. Similar views of the reduced mass are shown in FIGS. 3B and 3C, which show the mass taken out of the volute casing 316*a* relative to the volute casing 316*b*.

In some cases, refrigerant return from the AFD can go to the condenser and/or the economizer. For example, venting from line 218 can be to an economizer, e.g. 140 in FIG. 1, rather than to the condenser, e.g. 120 in FIG. 1. In cases, where there may be a need and/or desire to have the temperature of the AFD to stay relatively low, refrigerant may be returned to the economizer, e.g. 140 in FIG. 1. For example, when the condenser cooling tower is running at a high temperature, the economizer may be at a lower temperature by delivering the refrigerant to the economizer and which can be used to cool the drive. It will be appreciated that appropriate piping may be employed to fluidly connect the refrigerant return, e.g. vent line 218 to the economizer. In such an instance of directing the return refrigerant to for example the economizer, pressure may be added to the refrigerant by way of the refrigerant pump 206, of which this higher pressure is taken to an end point pressure that is lower, for example by way of an orifice, which can thereby reduce refrigerant flow and reduce refrigerant temperature. This can bring lower temp refrigerant into the drive, even when for example the cooling tower may be at a high temperature.

Figure 4:
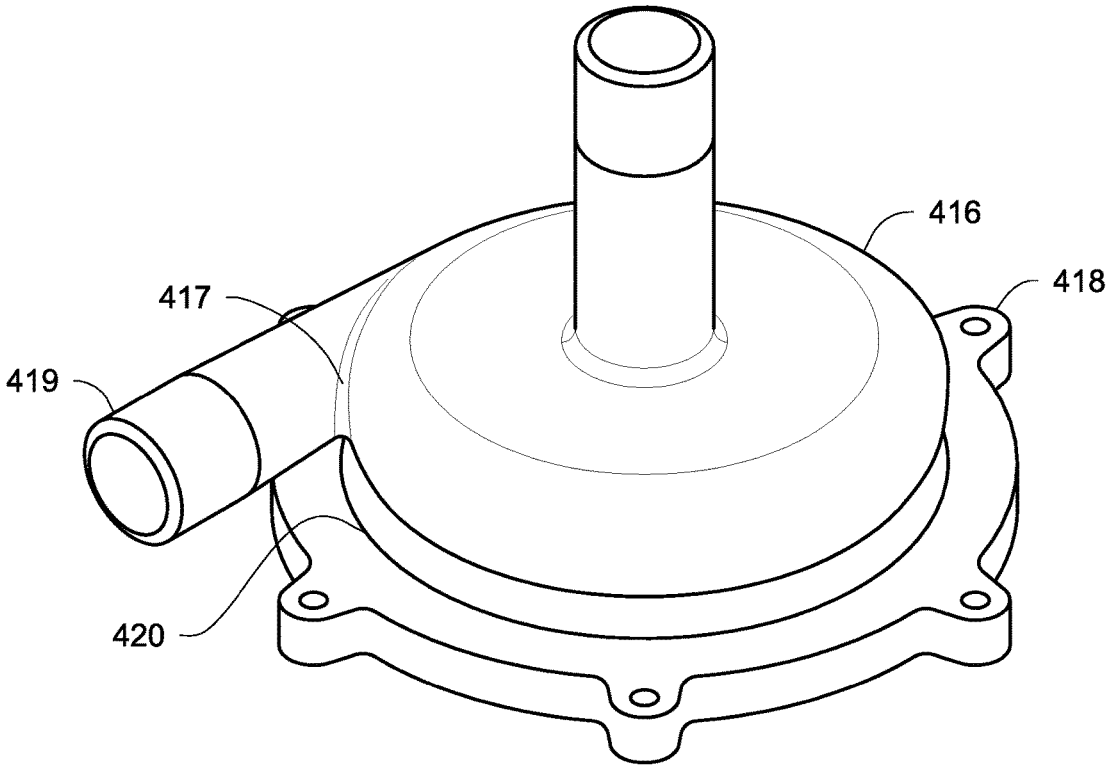
FIG. 4 illustrates another embodiment of a volute casing of a refrigerant pump.

FIG. 4 illustrates another embodiment of a volute casing 416 of a refrigerant pump, which is a reduced mass volute casing. As shown in FIG. 4, external portions of the volute casing 416 have been removed to reduce the overall mass of the volute casing. It will be appreciated that internal portions of the volute casing 416 can be similarly formed/constructed/made as in the volute casing 316*a*. Tabs 418 are positioned about the outer circumference of the volute casing 416 whereas compared to the outer circumference of the volute casing 316*b* is generally uniform and circular. The tabs 418 provide the structural assembly locations, such as for example bolt holes, for the volute casing 416 to connect to the pump housing. A tapered surface 417 may be disposed between the outlet pipe 419 and the volute 416, e.g. its main portion. A ring 420 can be disposed between the volute 416, e.g. its main portion and the portion on which the tabs 418 are disposed.

Aspects

It will be appreciated that any of aspects 1 to 9 may be combined with any of aspects 10 to 13.

Aspect 1. A heating, ventilation, air conditioning (HVAC) unit for an HVAC system comprising: a compressor having a motor and a drive; a condenser fluidly connected to the compressor; an evaporator fluidly connected to the condenser; a unit controller; and a refrigerant cooling and lubrication assembly that comprises: a condenser source line fluidly connected to the condenser, the condenser source line having a flow control device, an evaporator source line fluidly connected to the evaporator, the evaporator source line having a flow control device, a refrigerant pump line fluidly connected to the condenser source line and fluidly connected to the evaporator source line, the condenser source line and the evaporator source line feed into the refrigerant pump line, the refrigerant pump line is fluidly connected to at least one of the motor and the drive of the compressor, a refrigerant pump located on the refrigerant pump line, the refrigerant pump having an inlet and an outlet fluidly connected with the refrigerant pump line, the refrigerant pump having a housing and a volute casing, the volute casing is configured with a mass suitable to reduce the amount of refrigerant vapor present in the refrigerant pump line, the volute casing having tabs configured to provide structural connection locations for the volute casing to be connected to the refrigerant pump housing, the volute casing having a portion with a relatively smaller circumference than a portion on which the tabs are disposed, and the outlet of the refrigerant pump being disposed on the portion on which the tabs are disposed and not on the portion with the relatively smaller circumference, and the volute casing being a casted part.

Aspect 2. The HVAC unit of aspect 1, wherein the volute casing has a mass of at or about 12 pounds.

Aspect 3. The HVAC unit of aspect 1 or 2, further comprising a connecting flange on at least one of the inlet and outlet, the connecting flange having assembly points structured as tabs thereon.

Aspect 4. The HVAC unit of any of aspects 1 to 3, further comprising a vent line fluidly connected to the refrigerant pump line, the vent line configured to relieve the refrigerant pump line of vapor refrigerant flowing through the refrigerant pump line and upstream from the compressor.

Aspect 5. The HVAC unit of aspect 4, wherein the vent line is oriented to access toward a top of the refrigerant pump line to vent vapor traveling through and toward the top of the refrigerant pump line.

Aspect 6. The HVAC unit of aspect 4 or 5, wherein the vent line further comprises a flow control device.

Aspect 7. The HVAC unit of any of aspects 4 to 6, wherein the vent line further comprises a line, the line includes a valve and is fluidly connected to a drive of a chiller.

Aspect 8. The HVAC unit of any of aspects 1 to 7, wherein the HVAC unit is a water chiller.

Aspect 9. The HVAC unit of any of aspects 1 to 8, wherein the HVAC unit is an oil free water chiller.

Aspect 10. A method of lubricating an HVAC unit comprising: directing a flow of refrigerant into a refrigerant cooling and lubrication assembly, the step of directing a flow of refrigerant includes directing refrigerant into at least one of a condenser source line and an evaporator source line and then directing the refrigerant into a refrigerant pump line and through a refrigerant pump; removing vapor in a refrigerant cooling and lubrication assembly, the step of removing vapor comprises directing the flow of refrigerant through a volute casing of the refrigerant pump, where the volute casing is configured with a mass suitable to reduce the amount of refrigerant vapor present in the refrigerant pump line, the volute casing having tabs configured to provide structural connection locations for the volute casing to be connected to the refrigerant pump housing, the volute casing having a portion with a relatively smaller circumference than a portion on which the tabs are disposed, and the outlet of the refrigerant pump being disposed on the portion on which the tabs are disposed and not on the portion with the relatively smaller circumference, and the volute casing being a casted part, the step of directing the flow of refrigerant through the volute casing includes lowering a temperature inside the refrigerant pump relative to the flow of refrigerant present in the refrigerant pump line; and lubricating at least one of a motor and a drive of a compressor by delivering refrigerant from an outlet of the refrigerant pump and refrigerant pump line of the refrigerant cooling and lubrication assembly.

Aspect 11. The method of aspect 10, wherein the step of removing vapor further comprises venting vapor refrigerant through a vent line fluidly connected to the refrigerant pump line so as to relieve the refrigerant pump line of vapor refrigerant flowing through the refrigerant pump line and upstream from the compressor.

Aspect 12. The method of aspect 11, wherein the step of venting comprises venting from a top of the refrigerant pump line to vent vapor traveling through and toward the top of the refrigerant pump line.

Aspect 13. The method of any of aspects 10 to 12, wherein the step of venting comprises returning refrigerant vapor to an economizer of the HVAC unit.

With regard to the foregoing description, it is to be understood that changes may be made in detail, without departing from the scope of the present invention. It is intended that the specification and depicted embodiments are to be considered exemplary only.

The invention claimed is:

1. A heating, ventilation, air conditioning (HVAC) unit for an HVAC system comprising:

a compressor having a motor and a drive;

a condenser fluidly connected to the compressor;

an evaporator fluidly connected to the condenser;

a unit controller; and a refrigerant cooling and lubrication assembly that comprises:

a condenser source line fluidly connected to the condenser, the condenser source line having a first flow control device, an evaporator source line fluidly connected to the evaporator, the evaporator source line having a second flow control device, a refrigerant pump line fluidly connected to the condenser source line and fluidly connected to the evaporator source line, the condenser source line and the evaporator source line feed into the refrigerant pump line, the refrigerant pump line is fluidly connected to at least one of the motor and the drive of the compressor, a refrigerant pump located on the refrigerant pump line, the refrigerant pump having an inlet and an outlet fluidly connected with the refrigerant pump line, the refrigerant pump having a housing and a volute casing, the volute casing is configured with a mass suitable to reduce the amount of refrigerant vapor present in the refrigerant pump line, wherein the inlet and the outlet of the refrigerant pump, the first flow control device, and the condenser are arranged such that refrigerant being directed from the condenser is directed through the first flow control device before being directed to the inlet and the outlet of the refrigerant pump; and wherein the inlet and the outlet of the refrigerant pump, the second flow control device, and the evaporator are arranged such that refrigerant being directed from the evaporator is directed through the second flow control device before being directed to the inlet and the outlet of the refrigerant pump.

2. The HVAC unit of claim 1, wherein the volute casing has a weight of at or about 12 pounds.

3. The HVAC unit of claim 1, further comprising a connecting flange on at least one of the inlet and outlet, the connecting flange having assembly points structured as tabs on the connecting flange.

4. The HVAC unit of claim 1, further comprising a vent line fluidly connected to the refrigerant pump line, the vent line configured to relieve the refrigerant pump line of vapor refrigerant flowing through the refrigerant pump line and upstream from the compressor.

5. The HVAC unit of claim 4, wherein the vent line is oriented to access toward a top of the refrigerant pump line to vent vapor traveling through and toward the top of the refrigerant pump line.

6. The HVAC unit of claim 4, wherein the vent line further comprises a third flow control device.

7. The HVAC unit of claim 4, wherein the vent line further comprises a line, the line includes a valve and is fluidly connected to a drive of a chiller.

8. The HVAC unit of claim 1, wherein the HVAC unit is a water chiller.

9. The HVAC unit of claim 1, wherein the HVAC unit is an oil free water chiller.

10. A method of lubricating an HVAC unit comprising:

directing a flow of refrigerant into a refrigerant cooling and lubrication assembly, the step of directing a flow of refrigerant includes directing refrigerant into at least one of a condenser source line and an evaporator source line and then directing the refrigerant into a refrigerant pump line and through a refrigerant pump;

removing vapor in a refrigerant cooling and lubrication assembly, the step of removing vapor comprises directing the flow of refrigerant through a volute casing of the refrigerant pump, where the volute casing is configured with a mass suitable to reduce the amount of refrigerant vapor present in the refrigerant pump line, the step of directing the flow of refrigerant through the volute casing includes lowering a temperature inside the refrigerant pump relative to the flow of refrigerant present in the refrigerant pump line; and lubricating at least one of a motor and a drive of a compressor by delivering refrigerant from an outlet of the refrigerant pump and refrigerant pump line of the refrigerant cooling and lubrication assembly, wherein the step of removing vapor further comprises venting vapor refrigerant through a vent line fluidly connected to the refrigerant pump line so as to relieve the refrigerant pump line of vapor refrigerant flowing through the refrigerant pump line and upstream from the compressor, and wherein the step of venting comprises venting from a top of the refrigerant pump line to vent vapor traveling through and toward the top of the refrigerant pump line.

11. A method of lubricating an HVAC unit comprising:

directing a flow of refrigerant into a refrigerant cooling and lubrication assembly, the step of directing a flow of refrigerant includes directing refrigerant into at least one of a condenser source line and an evaporator source line and then directing the refrigerant into a refrigerant pump line and through a refrigerant pump;

removing vapor in a refrigerant cooling and lubrication assembly, the step of removing vapor comprises directing the flow of refrigerant through a volute casing of the refrigerant pump, where the volute casing is configured with a mass suitable to reduce the amount of refrigerant vapor present in the refrigerant pump line, the step of directing the flow of refrigerant through the volute casing includes lowering a temperature inside the refrigerant pump relative to the flow of refrigerant present in the refrigerant pump line; and lubricating at least one of a motor and a drive of a compressor by delivering refrigerant from an outlet of the refrigerant pump and refrigerant pump line of the refrigerant cooling and lubrication assembly, wherein the step of removing vapor further comprises venting vapor refrigerant through a vent line fluidly connected to the refrigerant pump line so as to relieve the refrigerant pump line of vapor refrigerant flowing through the refrigerant pump line and upstream from the compressor, and wherein the step of venting comprises returning refrigerant vapor to an economizer of the HVAC unit.

* * * * *